US009689212B2

(12) United States Patent
Van Nieuwkoop

(10) Patent No.: US 9,689,212 B2
(45) Date of Patent: Jun. 27, 2017

(54) METHOD AND SYSTEM FOR DIRECTIONAL DRILLING AND COUPLING SUB

(71) Applicant: SHELL OIL COMPANY, Houston, TX (US)

(72) Inventor: Pieter Van Nieuwkoop, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 216 days.

(21) Appl. No.: 14/407,820

(22) PCT Filed: Jun. 14, 2013

(86) PCT No.: PCT/EP2013/062338
§ 371 (c)(1),
(2) Date: Dec. 12, 2014

(87) PCT Pub. No.: WO2013/186342
PCT Pub. Date: Dec. 19, 2013

(65) Prior Publication Data

US 2015/0122548 A1 May 7, 2015

(30) Foreign Application Priority Data

Jun. 15, 2012 (EP) ..... 12172224

(51) Int. Cl.
*E21B 17/04* (2006.01)
*E21B 7/06* (2006.01)
(Continued)

(52) U.S. Cl.
CPC ..... *E21B 17/04* (2013.01); *E21B 7/06* (2013.01); *E21B 7/065* (2013.01); *E21B 7/067* (2013.01);
(Continued)

(58) Field of Classification Search
CPC ..... E21B 17/04; E21B 17/043; E21B 47/12; E21B 7/06; E21B 7/065; E21B 7/067; E21B 7/18
(Continued)

(56) References Cited

U.S. PATENT DOCUMENTS 2,197,019 A 4/1940 Monroe
3,743,034 A 7/1973 Bradley
(Continued)

FOREIGN PATENT DOCUMENTS

CN 102220842 10/2011
WO 2005005767 A1 1/2005

OTHER PUBLICATIONS

PCT International Search Report, Application No. PCT/EP2013/062338 dated Jul. 12, 2013.

*Primary Examiner* — Taras P Bemko

(57) ABSTRACT

The present invention provides a system and method for directional drilling of a borehole in a formation along a predetermined trajectory. The method comprising the steps of: providing a directional drilling system, comprising a rotatable drill string comprising a first drill string section and a second drill string section; a drill bit connected to a downhole end of the drill string; and a coupling sub comprising a first end connected to the first drill string section; a second end connected to the second drill string section; a hinge member between the first end and the second end allowing hinging of the second end relative to the first end; and locking means, operable between a hinge mode and a locking mode for locking the hinge member to prevent hinging of the second end relative to the first end; operating the directional drilling system with the locking means in the locking mode to drill a substantially straight section of the trajectory; and operating the directional drilling system with
(Continued)

the locking means in the hinge mode to drill a curved section of the trajectory.

15 Claims, 3 Drawing Sheets

(51) Int. Cl.
*E21B 7/18* (2006.01)
*E21B 17/043* (2006.01)
*E21B 47/12* (2012.01)

(52) U.S. Cl.
CPC ..... *E21B 7/18* (2013.01); *E21B 17/043* (2013.01); *E21B 47/12* (2013.01)

(58) Field of Classification Search
USPC ..... 175/45, 61, 74
See application file for complete search history.

(56) References Cited

U.S. PATENT DOCUMENTS

| | | | | |
|---|---|---|---|---|
| 4,007,797 | A | 2/1977 | Jeter | |
| 6,216,802 | B1 | 4/2001 | Sawyer | |
| 2006/0266554 | A1* | 11/2006 | Blange | E21B 7/18 175/54 |
| 2009/0127000 | A1* | 5/2009 | Cousins | E21B 17/20 175/78 |

* cited by examiner

FIG. 1
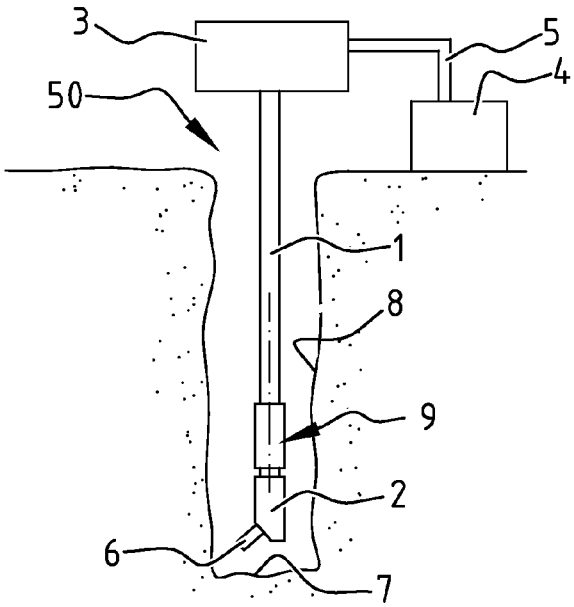
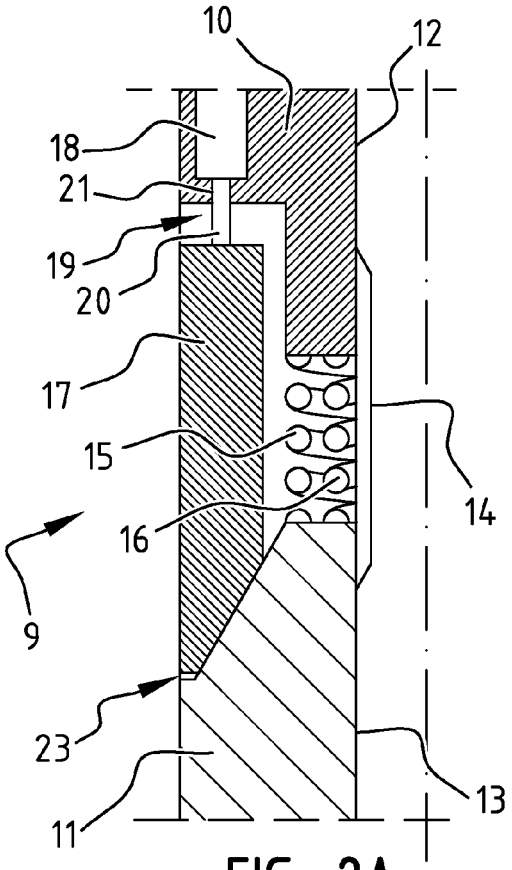
FIG. 2A
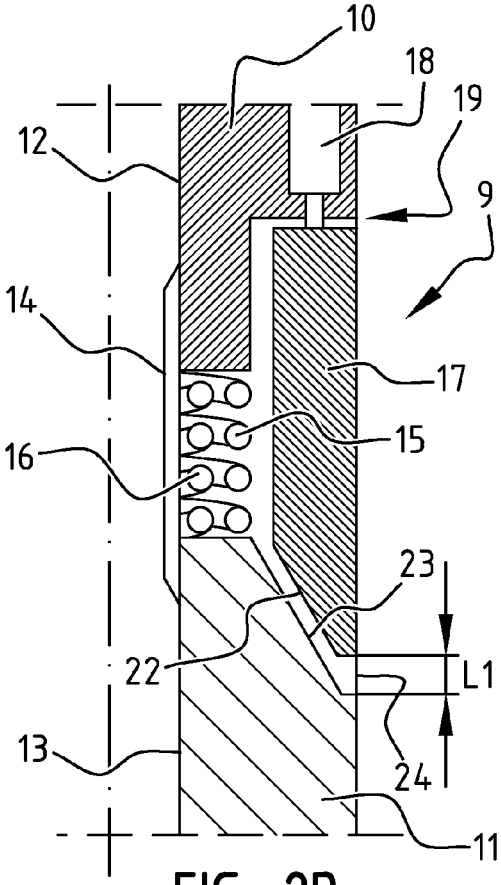
FIG. 2B

METHOD AND SYSTEM FOR DIRECTIONAL DRILLING AND COUPLING SUB

CROSS-REFERENCE TO RELATED APPLICATIONS

The present application is a National Stage (§371) of International Application No. PCT/EP2013/062338, filed Jun. 14, 2013, which claims priority from European Application No. 12172224.3, filed Jun. 15, 2012, the disclosures of each of which are hereby incorporated by reference in their entirety.

The invention relates to a method and system for directional drilling and to a coupling sub suitable for the system. The drilling system may be an abrasive jet drilling system. The method and system may be applied for drilling wellbores for the production of hydrocarbons.

An abrasive jet drilling system may comprise a rotatable drill string and a drill bit connected to a downhole end of the drill string. Said drill bit may comprise at least one jet nozzle for generating one or more jets of a mixture of drilling fluid and abrasive particles. The drill string is provided with a fluid passage for transferring the drilling fluid from an uphole end at surface to the drill bit.

Such drilling system is for instance disclosed in WO-2005/005767. The jet drilling system of WO-2005/005767 may be introduced in a borehole to erode to bottom thereof using the one or more abrasive jets, which are discharged from the jet nozzle. The abrasive particles may be circulated in the drilling system and may be introduced in the drill string mixed in the drilling fluid. Alternatively, the abrasive particles may be recycled using a downhole recycling device. Herein, less particles have to travel back and forth to surface, saving costs and improving efficiency.

The abrasive jet drilling system can produce both straight and curved boreholes. However, conventional steering techniques are generally unsuitable for the jet drilling system. For instance, abrasive jet drilling requires a relatively high drilling fluid pressure for the abrasive jet. In addition, abrasive jet drilling may obviate the requirement to apply weight on the drill bit (weight-on-bit (WOB)) or torque to the drill string as in conventional drilling systems.

The absence of weight on bit allows the application of flexibility in the drill string or the drilling assembly, enabling the drilling of curved sections having a relatively small radius. However, when drilling a straight section of the wellbore, the drill string and the drilling assembly are preferably relatively stiff. A stiff drilling assembly is more suitable to maintain a straight drilling direction, as a stiff drilling assembly has less or even no freedom of movement to deviate from a straight line. In contrast, a flexible drilling assembly would be better suited to drill in any desired direction, and would therefore be preferred for curved sections of the wellbore.

The present invention aims to provide an improved abrasive jet drilling system which is fit for both the drilling of straight sections and for directional drilling.

The invention therefore provides a coupling sub for coupling a first drill string section to a second drill string section in a directional drilling system, the coupling sub comprising:

- a first end connectable to the first drill string section;
- a second end connectable to the second drill string section;

- a hinge member between the first end and the section end allowing hinging of the second end relative to the first end; and
- locking means, operable between a hinge mode and a locking mode for locking the hinge member to prevent hinging of the second end relative to the first end.

The coupling sub is suitable to be included in a drill string comprising at least two adjoining drill string sections. The coupling sub connects said drill string section to each other and allows rotation of the drill string sections with respect to each other according to rotational axes which are oriented transversely with respect to the longitudinal direction of the drill string. The locking means have a locking mode for locking the drill string sections in aligned position and a free mode for allowing rotation of the drill bit parts with respect to each other. Herein, the hinge member transfers torque from the first drill string section to the second drill string section both in the hinge mode and in the locking mode. In the locking mode, the drill string sections are axially aligned. In the hinge mode, the hinge member allows the axis of the second drill string section to make an angle with respect to the axis of the first drill string section. The coupling sub functions for instance as a universal joint which can be locked in an aligned arrangement. In an embodiment, said angle between the first and second drill string sections may be in the range of about 2 to 20 degrees, for instance about 5 to 10 degrees.

The coupling sub according to the invention may be integrated in the drill string or in the drilling assembly, allowing the latter to be transferred between two modes. When drilling a straight borehole section, the drill string sections are locked in aligned relation with respect to each other. When drilling a curved section of the borehole the drill string sections are unlocked allowing the hinge member to hinge. This increases the flexibility of the drill string, allowing the drill string to follow a curved trajectory. In the hinge mode the drill string can bend in the direction of, or against, the borehole wall. Herein the angle between the axis of the drill bit and the axis of the borehole will change. Said angle changes substantially proportionally to the angle between the first and second drill string sections. As a result the bottom of the borehole will be eroded unevenly, creating an angle with respect to the borehole axis. The drilling system enables the drill bit to follow that angle and change the drilling direction.

The flexibility of the drill string can be obtained in different ways. According to a first possibility the coupling means comprise spring means, such as coaxial coil springs with opposite winding directions. According to another possibility, the coupling means comprise a universal joint.

In all those embodiments, the drill string parts each have a through going channel part, said through going channel parts being connected to each other through a flexible conduit which extends through the coupling means. By means of said flexible conduit, the flow of fluid, together with abrasive particles contained therein, can be reliably transferred through the flexible part of the drill string.

The locking means can be carried out in various ways as well. According to a preferred embodiment, the locking means comprise a locking sleeve which is carried by one of the drill string parts in such a way that said locking sleeve is translatable according to the longitudinal direction of said drill string part, said locking sleeve and the other drill string part comprising facing locking surfaces, whereby in the retracted position of the locking sleeve said locking surfaces are at the distance from each other and the drill string parts are rotatable with respect to each other and in the extended position said facing surfaces engage each other so as to prevent mutual rotations of the drill string parts. The mating locking surfaces are preferably carried out in such a way that a firm connection is obtained between the drill string parts. Preferably therefore, the mating surfaces are cone shaped.

Furthermore, the drill string part which carries the locking sleeve may comprise an actuator for displacing said locking sleeve. Preferably, the circumference of the drill string part which carries the locking sleeve and the circumference of the locking sleeve are sealed with respect to each other. Such sealing prevents the entry of cuttings and the like in the drill string. Furthermore, for this purpose the drill string part which carries the locking sleeve may be provided with a fixed blocking ring which surrounds the locking sleeve, a seal being provided between said blocking ring and the other drill string part.

Preferably a coupling sub is provided comprising the drill string sections, the hinge means and the locking means, said coupling sub being connected to and positioned between the drill string and the drill bit.

One or more coupling subs can be included in the drill string at any desired position along the drill string. In a practical embodiment, at least one coupling sub is included in the drill string relatively close to the drill bit. I.e., at least one coupling sub is included in the downhole end of the drill string, or alternatively is included in the bottomhole assembly (BHA).

The BHA is the downhole portion of the drill string, comprising (from the bottom up in a vertical well) the bit, bit sub, a mud motor (in certain cases only), and stabilizers. The bottomhole assembly provides a driller with directional control of the well. The BHA may include directional drilling and measuring equipment, measurements-while-drilling tools, logging-while-drilling tools and other specialized devices.

In an embodiment, the coupling sub can be controlled from surface to change between the hinge mode and the locking mode. The coupling sub may be provided with a downhole control unit for controlling the locking means; and signal means for providing a signal to the control unit, wherein the control means are adapted to transfer the locking means from the hinge position to the locking position or vice versa in response to the signal provided by the signal means.

Several possibilities exist for triggering the movement of the locking sleeve for the purpose of selecting a directional mode or a straight mode. For instance, the signal means may comprise a pressure sensor for sensing a pressure pulse pattern, a rotation sensor for sensing a drill string rotation pattern or a strain gauge for sensing a weight-on-bit pattern. According to one of these possibilities, a pressure pulse pattern is generated at surface which can be detected by the sensor of the coupling sub. Alternatively, it is possible to generate a drill string rotation pattern at surface for detection by the signal means. In that case, the rotation sensor is used. If the signal means include a load sensor, such as a strain gauge, a weight-on-bit pattern may be generated.

Preferably, the signal means comprise a unit for comparing directional data and/or formation evaluation measurements with pre-programmed desired directional data or formation characteristics.

According to another aspect, the invention provides a directional drilling system including the coupling sub as described above.

According to yet another aspect, the invention provides a method for directional drilling of a borehole in a formation along a predetermined trajectory, the method comprising the steps of:

providing a directional drilling system, comprising a rotatable drill string comprising a first drill string section and a second drill string section; a drill bit connected to a downhole end of the drill string; and a coupling sub comprising a first end connected to the first drill string section; a second end connected to the second drill string section; a hinge member between the first end and the second end allowing hinging of the second end relative to the first end; and locking means, operable between a hinge mode and a locking mode for locking the hinge member to prevent hinging of the second end relative to the first end;

operating the directional drilling system with the locking means in the locking mode to drill a substantially straight section of the trajectory; and operating the directional drilling system with the locking means in the hinge mode to drill a curved section of the trajectory.

Exemplary embodiments of the invention will be described below with reference to the drawings, wherein:

FIG. 1 shows a cross-section of a directional drilling system according to the invention;

FIG. 2A shows a cross-section of an embodiment of a coupling sub according to the invention in a locking mode;

FIG. 2B shows a cross-section of the embodiment of FIG. 2A in a hinge mode;

Figure 3A:
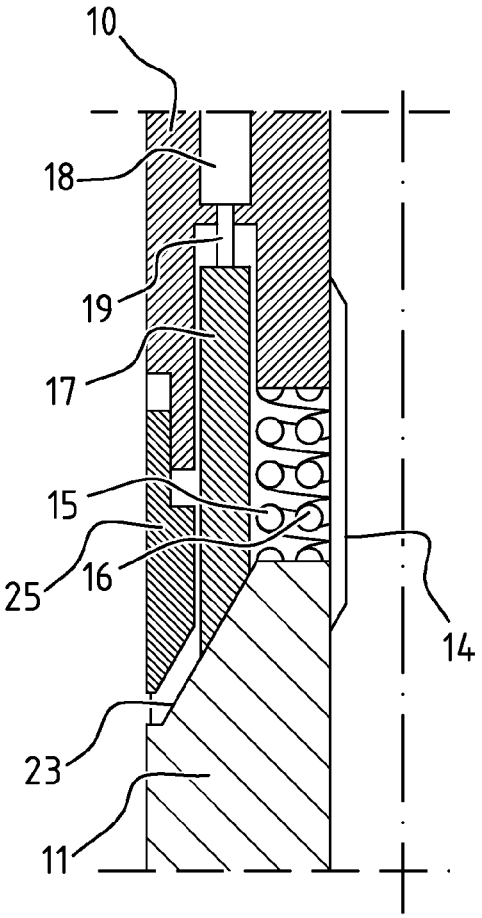
FIG. 3A shows a cross-section of another embodiment of a coupling sub according to the invention in a locking mode.

FIG. 1 shows a directional drilling system 50 comprising a drill string 1 and an abrasive jet drill bit 2. The drill string 1 is connected to drive means 3 for rotating the drill string. The drive means shown in FIG. 1 include a top drive, which is located at surface. Pump 4 and piping 5 may be coupled to the drive means 3, for directing a drilling fluid and optionally abrasive particles through an internal fluid passage of the drill string 1 towards the drill bit 2. The drill bit 2 may be provided with one or more jet nozzles 6 for discharging a jet of drilling fluid and abrasive particles towards the bottom 7 of the wellbore.

When drilling, a mixture of drilling fluid and abrasive particles is pumped down the drill string 1 and discharged from the nozzle 6. The discharged drilling fluid is returned up the borehole 8 towards surface. The drilling fluid may subsequently be returned to the pump 4. The abrasive particles may be returned as well. Alternatively, the abrasive particles may be re-circulated downhole, for instance using a magnetic recirculation system (not shown).

A coupling sub 9 may be accommodated in the drill string 1. The coupling sub 9 can be transferred from a stiff mode to a flexible mode and vice versa. In the stiff mode, the whole of the drill string 1, the body sub 9 and the drill bit 2 are aligned, forming a stiff longitudinal body for drilling a straight borehole. In the flexible mode, the coupling sub allows the first end thereof to hinge with respect to the opposite end. Thus, the drill bit 2 can hinge with respect to the upper part of the drill string 1. The flexible mode is most suitable for drilling curved sections of the borehole.

FIG. 2 shows a first drill string section 10 and a second drill string section 11. Each of the drill string sections are provided with a fluid channel 12, 13, which are to be included in the internal fluid passage of the drill string 1. The fluid channels 12, 13 are connected by a flexible conduit 14. The drill string sections 10, 11 are connected by an outer coil 15 and an inner coil 16. The coils 15, 16 provide a predetermined flexibility in bending of the first drill string section 10 relative to the second drill string section 11. At the same time, as a result of the opposite winding direction of the coils 15, 16, the coils transfer torque from the first drill string section to the second drill string section. In other words, the springs 15, 16 allow axial hinging of the first drill string section relative to the second drill string section, but transmit rotary motion.

The first drill string section 10 is provided with a locking sleeve 17 which is connected to an actuator 18. The actuator can move the locking sleeve 17 in axial direction. The actuator includes for instance one or more hydraulic cylinders provided with corresponding pistons 19. The pistons may be connected to extendable rods 20. The rods 20 extend between the actuator 18 and the locking sleeve 17. The rods 20 may extend through a bore 21 provided in an end of the first drill string section 10. An end of the locking sleeve facing the second drill string section 11 may be shaped in the form of an inverted cone 22. An end part 23 of the second drill string section 11 may have a cone shape, corresponding to the inverted cone 22.

FIG. 2A shows the locking means in the locking mode. Herein, the pistons 19 are extended, pushing sleeve 17 forward wherein the inner surface 22 engages the corresponding outer surface 23. The locking sleeve 17 may be pressed against the locking surface 23 of the second drill string section 11. Herein, the cones 22, 23 are pushed against each other, preventing hinging of the drill string sections 10, 11.

FIG. 2B shows the locking sleeve 17 in the hinge mode. Herein, the pistons 19 are retracted and the sleeve 17 is moved away from the second drill string section 11 along a distance L1. The retracted sleeve leaves a clearance between the inner surface 22 of the sleeve 17 and the outer surface of the second drill string section 11. Due to the clearance, the drill string sections 10, 11 are able to axially hinge with respect to each other, within the constraints posed by, for instance, the coil springs 15, 16.

The level of flexibility allowed by the coupling sub in the hinge mode (FIG. 2B) can be maximized to a predetermined level. For instance, the distance L1 can be limited so that the sleeve surface 22 will engage the locking surface 23 at a predetermined angle of hinging. The maximum angle may for instance be in the order of 5 to 20 degrees. The distance L1 may for instance be in range of 1 to 5 inch (2.5 to 12.5 cm).

A flexible seal 24 may be arranged between the end of the locking sleeve 17 and the second drill string part 11 and/or between the opposite end of the sleeve 17 and the first drill string section 10. The seal 24 may prevent the entry of unwanted materials, such as drill cuttings, drilling fluid and the like, between the sleeve 17 and the drill string sections 10, 11.

In the embodiment of FIG. 3, the locking sleeve 17 has a smaller outer diameter. The smaller diameter enables to apply a blocking ring 25. The blocking ring 25 has a cone shaped surface 26 corresponding to the surface 23 of the second drill string section 11. The blocking ring prevents the entry of unwanted materials, such as cuttings or abrasive particles. The flexible seal 24 may be applied between the lower end of the blocking ring 25 and the second drill string section 11.

Figure 3B:
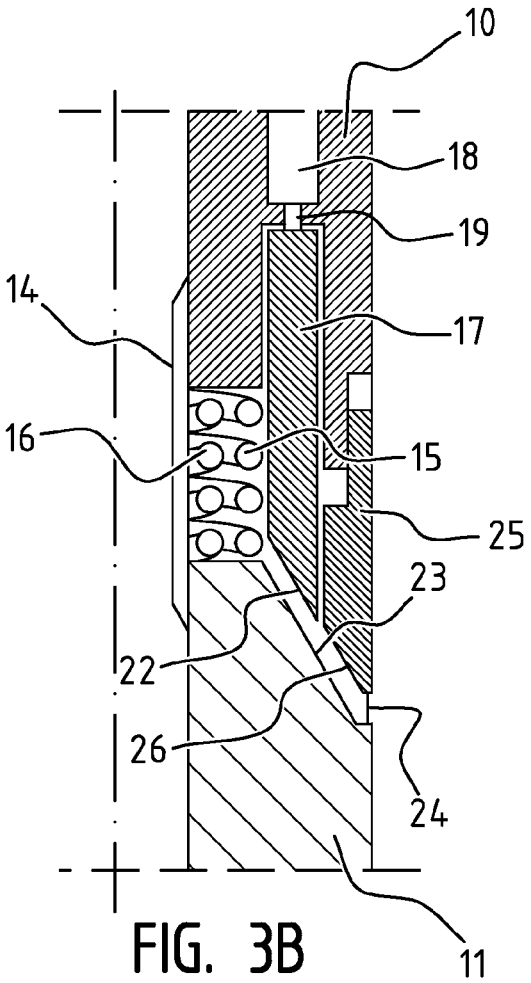
FIG. 3B shows a cross-section of the embodiment of FIG. 3A in a hinge mode.

The embodiment of FIG. 3 functions similar to the embodiment of FIG. 2. In the locking mode (FIG. 3A), the actuator 18 pushes the sleeve 17 towards the second drill string section. Herein, the inner surface 22 of the sleeve 17 and the outer surface 23 of the second drill string section 11 engage each other. In the hinge mode (FIG. 3B), the actuator has moved the sleeve a predetermined distance away from the second drill string section 11, leaving a clearance between said locking surfaces 22, 23.

In the embodiment of FIG. 4, the first and second drill string sections 10, 11 are connected using a universal joint 27. Herein, a universal joint or universal coupling may also be referred to as a Cardan joint. The universal joint is a coupling in a substantially rigid pipe that allows the pipe to bend in any direction, while being able to transmit rotary motion. The universal joint may comprise a pair of hinges located close together, oriented at 90 degrees to each other. The hinges may be connected by a cross shaft.

Figure 4A:
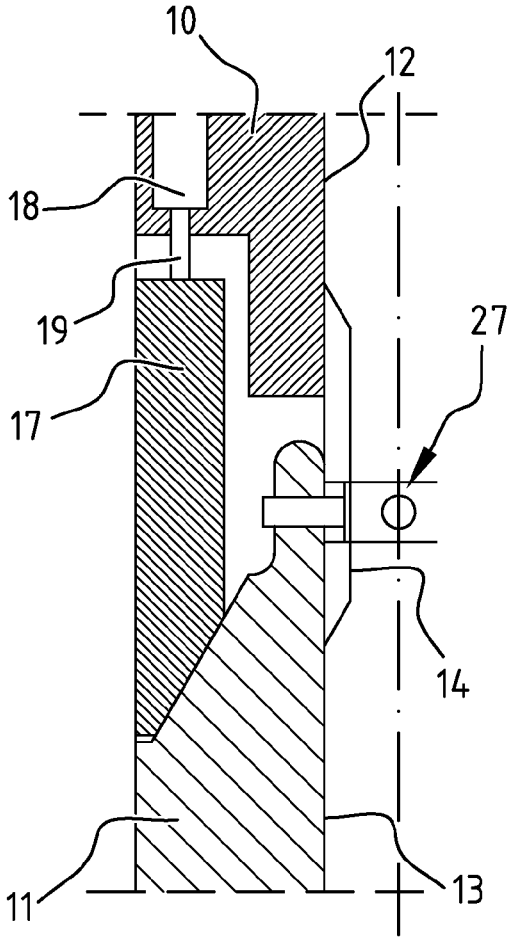
FIG. 4A shows a cross-section of yet another embodiment of a coupling sub according to the invention in a locking mode.
Figure 4B:
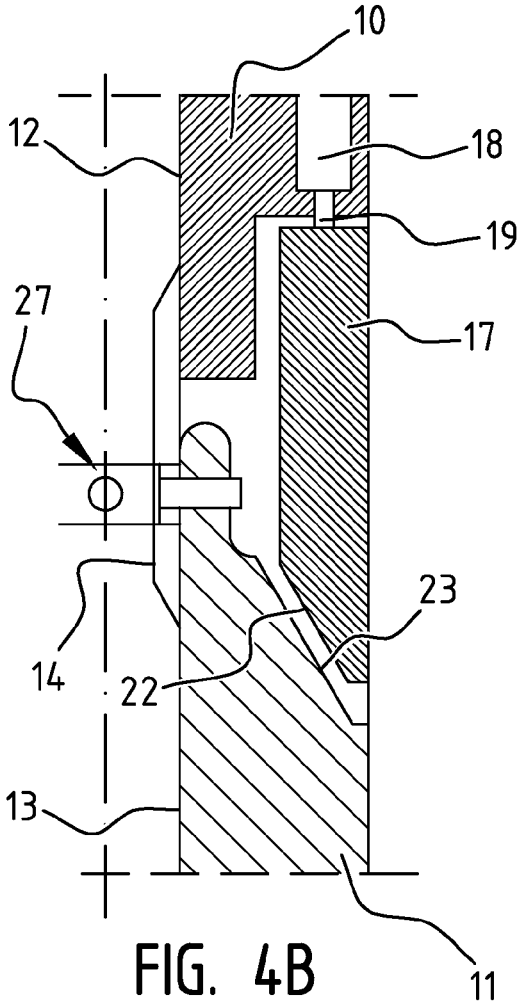
FIG. 4B shows a cross-section of the embodiment of FIG. 4A in a hinge mode.

The embodiment of FIG. 4 functions similar to the embodiment of FIG. 2. The actuator 18 pushes the sleeve 17 towards the second drill string section 11. In the locking mode (FIG. 4A), the inner surface 22 of the sleeve 17 and the outer surface 23 of the second drill string section 11 engage each other. In the hinge mode (FIG. 4B), the actuator has moved the sleeve a predetermined distance away from the second drill string section 11, leaving a clearance between said locking surfaces 22, 23.

The present invention is not limited to the above described embodiments thereof, wherein many modifications are conceivable within the scope of the appended claims. For instance, features of respective embodiments may be combined.

The invention claimed is:

1. A coupling sub for coupling a first drill string section to a second drill string section in a directional drilling system, the coupling sub comprising:

a first end connectable to the first drill string section;

a second end connectable to the second drill string section;

a hinge member between the first end and the section end allowing hinging of the second end relative to the first end; and locking means, operable between a hinge mode, allowing hinging of the first end with respect to the second end, and a locking mode for locking the hinge member to prevent hinging of the second end relative to the first end, wherein the locking means comprise:

a locking sleeve which is moveable in axial direction with respect to the first drill string section between a locking mode and a hinge mode, and being provided with at least one sleeve lock surface;

at least one locking surface being provided on an end part of the second drill string section and being complementary to the sleeve lock surface, wherein in the hinge mode of the locking sleeve said sleeve lock surface is located at a distance from the locking surfaces enabling the first drill string section to hinge with respect to the second drill string section, and wherein in the locking mode said sleeve lock surface engages said locking surface to prevent hinging of the first drill string section with respect to the second drill string section.

2. The coupling sub according to claim 1, wherein the hinge member comprises spring means.

3. The coupling sub of claim 2, wherein the spring means include a pair of coaxial coil springs having opposite winding directions.

4. The coupling sub according to claim 1, wherein the hinge member comprises a universal joint.

5. The coupling sub according to claim 1, wherein the first end and the second end are each provided with a fluid channel being connected by a flexible conduit extending through the hinge member.

6. The coupling sub according to claim 1, wherein the sleeve lock surface and the locking surface are cone shaped.

7. The coupling sub according to claim 1, wherein the first end is provided with an actuator for displacing said locking sleeve between the locking mode and the hinge mode.

8. The coupling sub according to claim 1, comprising a seal for sealing the locking means with respect to the first drill string section and/or the second drill string section.

9. The coupling sub according to claim 1, wherein the first drill string section is provided with a fixed blocking ring surrounding the locking sleeve and wherein a seal is provided between said blocking ring and the second drill string section.

10. The coupling sub according to claim 1, comprising:

a downhole control unit for controlling the locking means; and signal means for providing a signal to the control unit, wherein the control means are adapted to transfer the locking means from the hinge mode to the locking mode or vice versa in response to the signal provided by the signal means.

11. The coupling sub according to claim 10, wherein the signal means are selected from the group comprising: a pressure sensor for sensing a pressure pulse pattern, a rotation sensor for sensing a drill string rotation pattern, and a load sensor, such as a strain gauge, for sensing a weight-on-bit pattern.

12. The coupling sub according to claim 10, wherein the control unit is adapted for comparing directional data and/or formation evaluation measurements with pre-programmed desired directional data or formation characteristics.

13. A directional drilling system, comprising:

a rotatable drill string comprising a first drill string section and a second drill string section;

a drill bit connected to a downhole end of the drill string; and a coupling sub comprising:

a first end connected to the first drill string section;

a second end connected to the second drill string section;

a hinge member arranged between the first end and the second end allowing hinging of the second end relative to the first end; and locking means, operable between a hinge mode and a locking mode for locking the hinge member to prevent hinging of the second end relative to the first end, wherein the locking means comprise:

a locking sleeve which is moveable in axial direction with respect to the first drill string section between a locking mode and a hinge mode, and being provided with at least one sleeve lock surface;

at least one locking surface being provided on an end part of the second drill string section and being complementary to the sleeve lock surface, wherein in the hinge mode of the locking sleeve said sleeve lock surface is located at a distance from the locking surfaces enabling the first drill string section to hinge with respect to the second drill string section, and wherein in the locking mode said sleeve lock surface engages said locking surface to prevent hinging of the first drill string section with respect to the second drill string section.

14. Drilling system of claim 13, wherein the drilling system comprises an abrasive jet drilling system.

15. A method for directional drilling of a borehole in a formation along a predetermined trajectory, the method comprising the steps of:

providing a directional drilling system, comprising a rotatable drill string comprising a first drill string section and a second drill string section; a drill bit connected to a downhole end of the drill string; and a coupling sub comprising a first end connected to the first drill string section; a second end connected to the second drill string section; a hinge member between the first end and the second end allowing hinging of the second end relative to the first end; and locking means, operable between a hinge mode and a locking mode for locking the hinge member to prevent hinging of the second end relative to the first end, wherein the locking means comprise a locking sleeve which is moveable in axial direction with respect to the first drill string section between a locking mode and a hinge mode, and being provided with at least one sleeve lock surface, at least one locking surface being provided on an end part of the second drill string section and being complementary to the sleeve lock surface, wherein in the hinge mode of the locking sleeve said sleeve lock surface is located at a distance from the locking surfaces enabling the first drill string section to hinge with respect to the second drill string section, and wherein in the locking mode said sleeve lock surface engages said locking surface to prevent hinging of the first drill string section with respect to the second drill string section;

operating the directional drilling system with the locking means in the locking mode to drill a substantially straight section of the trajectory; and operating the directional drilling system with the locking means in the hinge mode to drill a curved section of the trajectory.

* * * * *